US005614932A

United States Patent [19]

Kagayama

[11] Patent Number: 5,614,932

[45] Date of Patent: Mar. 25, 1997

[54] IMAGE FORMING APPARATUS

[75] Inventor: Shigeru Kagayama, Owariasahi, Japan

[73] Assignee: Brother Kogyo Kabushiki Kaisha, Nagoya, Japan

[21] Appl. No.: 636,300

[22] Filed: Apr. 23, 1996

[30] Foreign Application Priority Data

May 16, 1995 [JP] Japan ..... 7-116971

[51] Int. Cl.[6] ..... B41J 2/06; G03G 15/06

[52] U.S. Cl. ..... 347/55; 399/55; 399/285

[58] Field of Search ..... 355/261, 262, 355/265, 245; 347/55, 120, 123, 128; 118/647, 648, 650

[56] References Cited

U.S. PATENT DOCUMENTS

| | | | |
|---|---|---|---|
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,860,036 | 8/1989 | Schmidlin | 347/55 |
| 4,876,561 | 10/1989 | Schmidlin | 347/55 |
| 4,903,049 | 2/1990 | Sotack | 347/55 |
| 4,949,103 | 8/1990 | Schmidlin et al. | 347/55 |
| 5,036,341 | 7/1991 | Larsson . | |
| 5,038,159 | 8/1991 | Schmidlin et al. | 347/55 |
| 5,040,004 | 8/1991 | Schmidlin et al. | 347/55 |
| 5,121,144 | 6/1992 | Larson et al. | 347/55 |
| 5,204,696 | 4/1993 | Schmidlin et al. | 347/55 |
| 5,374,949 | 12/1994 | Wada et al. | 355/265 X |
| 5,402,158 | 3/1995 | Larson | 347/128 X |
| 5,508,723 | 4/1996 | Maeda | 347/55 |
| 5,523,777 | 6/1996 | Kitamura | 347/55 |
| 5,530,464 | 6/1996 | Hiwada | 347/55 |
| 5,539,438 | 7/1996 | Maeda | 347/55 |
| 5,552,814 | 9/1996 | Maeda et al. | 347/55 |

FOREIGN PATENT DOCUMENTS

| | | |
|---|---|---|
| 0587366 | 3/1994 | European Pat. Off. . |
| 6-255163 | 9/1994 | Japan . |

*Primary Examiner*—Matthew S. Smith
*Attorney, Agent, or Firm*—Oliff & Berridge

[57] ABSTRACT

A back electrode roller is connected to a back voltage applying circuit. When a sheet of paper is not located at a position corresponding to toner passage apertures, or when a non-printing portion of the sheet of paper is located at the position corresponding to the apertures, an inhibiting voltage for preventing attraction of the toner is applied from the back voltage applying circuit to the back electrode roller. Accordingly, even when the toner erroneously passes through the apertures, the attraction of the toner toward the back electrode roller can be prevented by the application of the inhibiting voltage.

16 Claims, 4 Drawing Sheets

IMAGE FORMING APPARATUS

BACKGROUND OF THE INVENTION

1. Field of the Invention

The invention relates to an image forming apparatus which can be used in printing devices, such as a copying machine, printer, plotter, or facsimile.

2. Description of Related Art

Conventionally, a type of image forming apparatus is disclosed in European Patent Publication No. 587/366. The image forming apparatus disclosed in this publication is one designed to apply a drive signal according to an image signal to an aperture electrode unit having a plurality of small holes (which will be hereinafter referred to as apertures), thereby controlling the passage of toner particles through the apertures and forming an image on an image recording medium such as a sheet of printing paper by the toner particles passed through the apertures.

Such an image forming apparatus 100 is shown in FIG. 3. As shown in FIG. 3, a toner carrying roller 114 and a sheet of paper 120 are opposed to each other with an aperture electrode unit 101 sandwiched therebetween. A back electrode roller 122 is provided above, i.e., on the back or opposite side of the paper 120.

An enlarged perspective view of the aperture electrode unit 101 of the image forming apparatus 100 is shown in FIG. 4. The aperture electrode unit 101 comprises a polyimide insulating sheet 102 having a thickness of 25 μm, a plurality of apertures 106 each having a diameter of 100 μm, formed through the insulating sheet 102 and arranged in a line in the longitudinal direction of the insulating sheet 102, and a plurality of control electrodes 104 respectively formed around the plural apertures 106, each control electrode 104 being formed from a copper foil and having a thickness of 1 μm and a width of 20 μm. As shown in FIG. 3, the aperture electrode unit 101 is placed in such a manner that the control electrodes 104 face the paper 120. In the image forming apparatus 100, a control voltage according to an image signal is applied from a control voltage applying circuit 108 to the control electrodes 104 to thereby control passage of a toner 116, carried by the toner carrying roller 114, through the apertures 106. Further, a voltage of +1 kV is always applied from a DC power supply 124 to the back electrode roller 122 to strongly attract the toner 116 passed through the apertures 106 toward the paper 120, thus forming an image on the paper 120.

In the conventional image forming apparatus as mentioned above, however, the voltage of +1 kV is always kept applied to the back electrode roller 122 in a powered condition of the apparatus. In other words, the voltage of +1 kV is constantly applied to the back electrode roller 122 even in a non-printing condition of the apparatus so long as power is applied. Accordingly, in the event that a residual toner deposited in the vicinity of the apertures erroneously passes through the apertures in the non-printing condition, the residual toner having passed through the apertures is attracted toward the back electrode roller by an attracting electric field formed between the control electrodes and the back electrode roller. Such attraction of the uncontrolled toner toward a non-printing portion causes fog on the paper when the paper is present at a position above the apertures, resulting in stain of the paper with the toner, or alternatively causes a stain on the back electrode roller with the toner when the paper is absent at the position above the apertures, which is subsequently placed on the back of the next sheet of paper to be printed. As a result, a deterioration in the quality of an output image is caused in both cases.

SUMMARY OF THE INVENTION

An object of the invention is to provide an image forming apparatus capable of printing with an excellent image quality and stable image formation.

According to the invention, there is provided in an image forming apparatus including an electrode array having a plurality of charged particle passing portions and a plurality of control electrodes respectively corresponding to the charged particle passing portions; charged particle supplying means for supplying charged particles to the charged particle passing portions of the electrode array; a back electrode located opposite to the charged particle supplying means with respect to the electrode array, for attracting the charged particles passed through the charged particle passing portions toward an image recording medium; and back voltage control means connected to the back electrode, for selectively applying to the back electrode an attraction voltage for attracting the charged particles and an inhibiting voltage for inhibiting attraction of the charged particles.

In the image forming apparatus of the invention, having the above structure, when the charged particle supplying means supplies charged particles to the charged particle passing portions of the electrode array, the electrode array controls the passage of the charged particles through the charged particle passing portions, and the back voltage control means selectively applies to the back electrode an attraction voltage for attracting the charged particles and an inhibiting voltage for inhibiting attraction of the charged particles, thereby either attracting the charged particles toward an image recording medium or inhibiting the attraction of the charged particles according to the voltage applied to the back electrode.

As is apparent from the above description, according to the image forming apparatus of the invention, the inhibiting voltage for inhibiting the attraction of the charged particles is applied to the back electrode as required, thereby preventing the back electrode or the image recording medium from being stained with the charged particles and accordingly being capable of printing with excellent image quality and stable image formation.

BRIEF DESCRIPTION OF THE DRAWINGS

A preferred embodiment of the invention will be described in detail with reference to the following drawings wherein.

DETAILED DESCRIPTION OF THE PREFERRED EMBODIMENT

Figure 1:
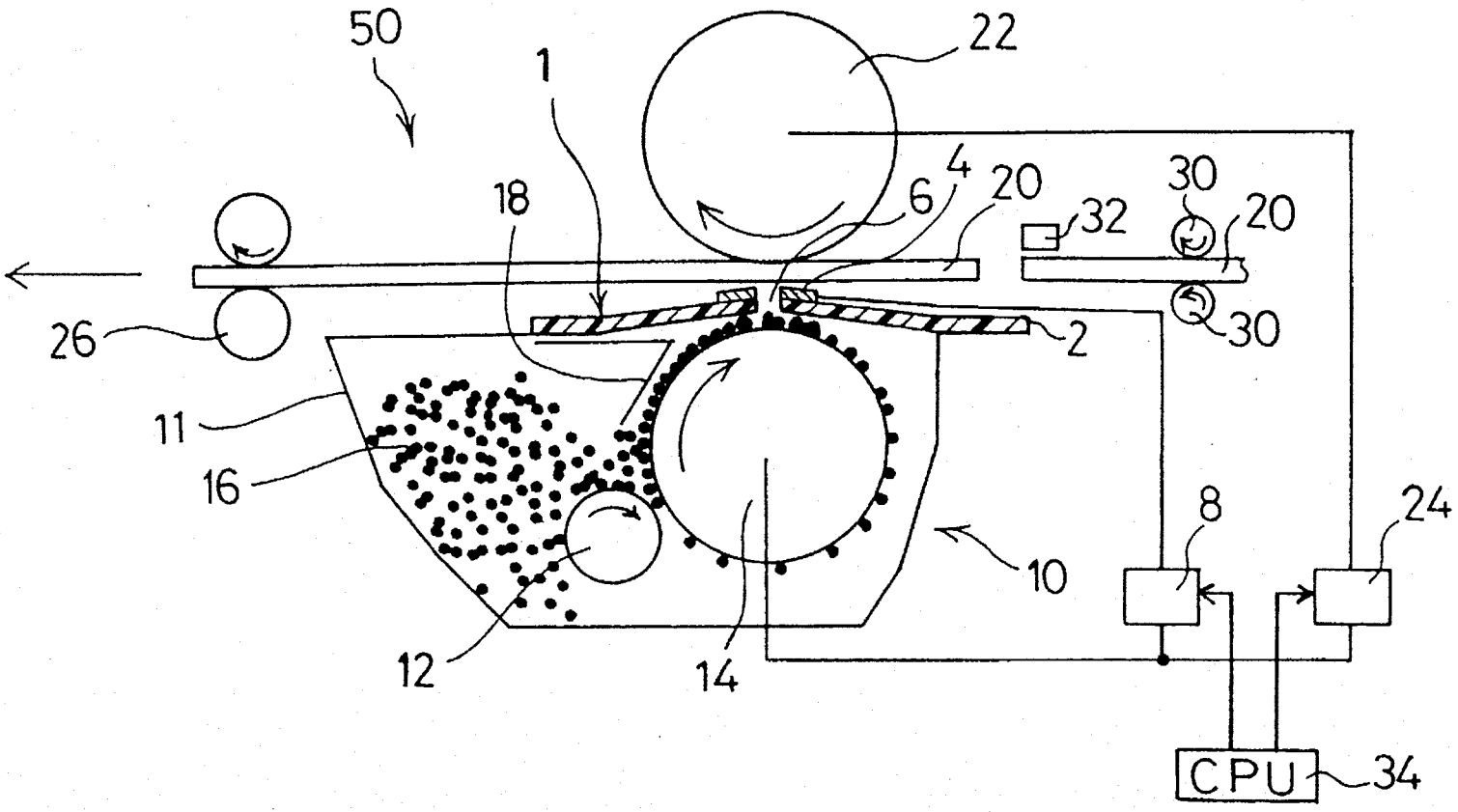
FIG. 1 is a cross-sectional view showing the structure of an image forming apparatus according to a preferred embodiment of the invention.

The structure of an image forming apparatus 50 according to a preferred embodiment will be described with reference to FIG. 1.

The image forming apparatus 50 is provided at its lower portion with a toner supplying device 10. An aperture electrode unit 1 for controlling a toner flow is located above the toner supplying device 10. A back electrode roller 22 is located above the aperture electrode unit 1, with a spacing of 1 mm being maintained between the back electrode roller 22 and the aperture electrode unit 1. A sheet of paper 20, on which an image is formed by a toner, is inserted into the spacing between the aperture electrode unit 1 and the back electrode roller 22 and fed in the direction of the arrow by rotation of the back electrode roller 22 in the direction of the arrow. A fixing device 26 for fixing an image on the paper 20 is located at a downstream position with respect to the feeding direction of the paper 20.

Further, a pair of feed rollers 30, for feeding the paper 20 toward the aperture electrode unit 1, and a sensor 32, for detecting the presence or absence of the paper 20, are located at upstream positions with respect to the feeding direction of the paper 20.

The details of each member of the image forming apparatus 50 mentioned above will now be described with reference to the drawings.

As shown in FIG. 1, the toner supplying device 10 is provided with a toner case 11 serving also as a housing for the toner supplying device 10 as a whole. Toner 16 is stored in the toner case 11. A cylindrical toner carrying roller 14, for carrying the toner 16 and feeding it to the aperture electrode unit 1, is supported in the toner case 11 so as to be rotatable in the direction of the arrow. A cylindrical supply roller 12 is located on the left lower side of the toner carrying roller 14, as viewed in FIG. 1, so as to be rotatable in the direction of the arrow. The supply roller 12 serves to supply the toner 16 stored in the toner case 11 to the toner carrying roller 14. The supply roller 12 and the toner carrying roller 14 are parallel to each other, and the generators of the cylindrical surfaces of these rollers 12 and 14 are in contact with each other.

A toner layer restricting blade 18 is located above the supply roller 12 in the toner case 11 in such a manner that one end of the blade 18 is in pressure contact with the toner carrying roller 14. The toner layer restricting blade 18 serves to adjust the amount of the toner 16 to be carried by the toner carrying roller 14 so that a uniform layer of the toner 16 is formed on the cylindrical surface of the toner carrying roller 14. The toner layer restricting blade 18 also serves to uniformly the charge of the toner 16.

Figure 4:
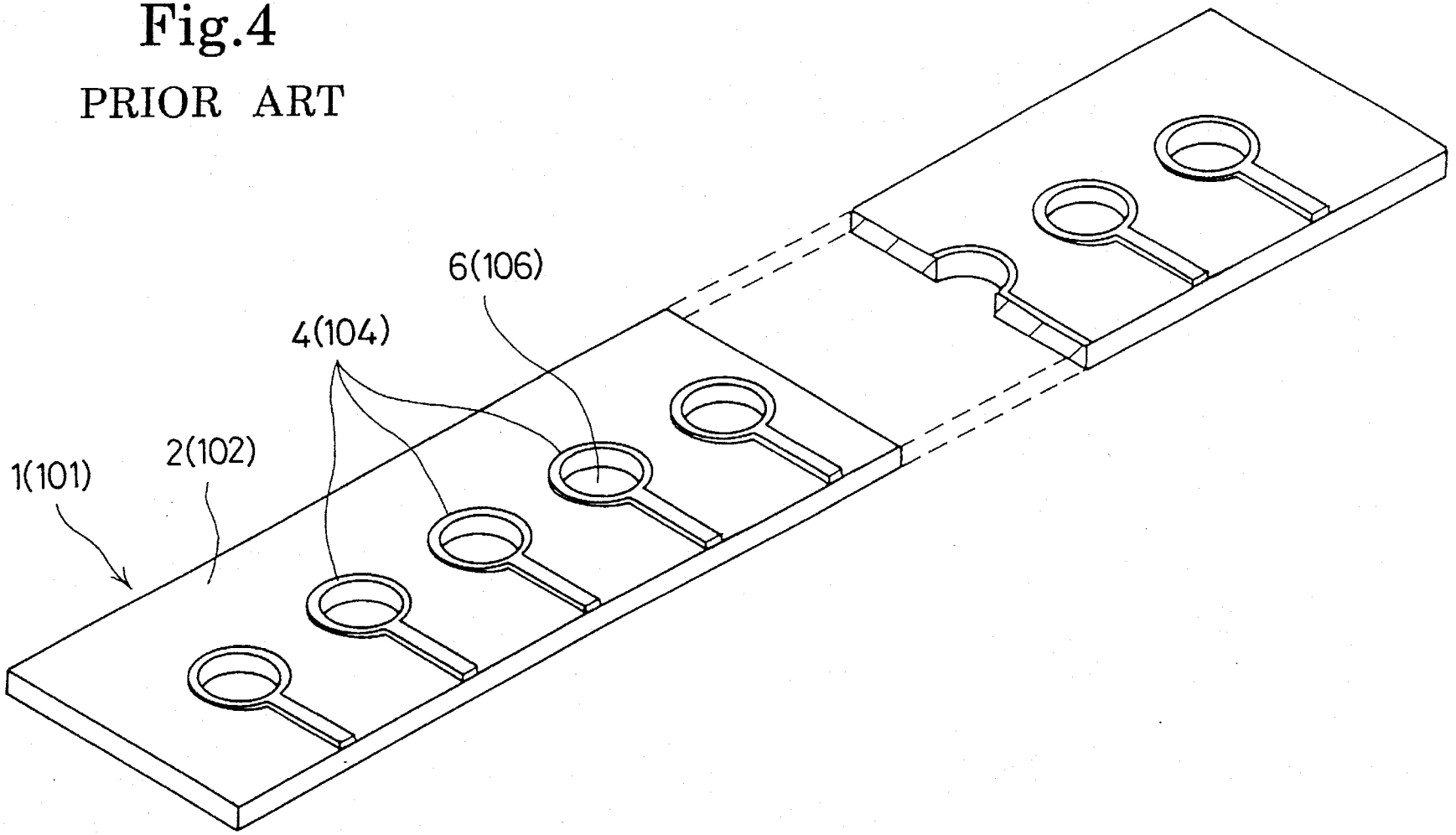
Fig.4 PRIOR ART
FIG. 4 is a perspective view showing the structure of an aperture electrode unit commonly used in the image forming apparatus of the preferred embodiment and the prior art.

The structure of the aperture electrode unit 1 is the same as that of the prior art aperture electrode 101, and the detailed description thereof will be herein omitted. In brief, as shown in FIG. 4, a plurality of apertures 6 are formed through an insulating sheet 2 so as to be arranged in a line in the longitudinal direction of the insulating sheet 2. Further, a control electrode 4 is formed around each aperture 6.

Although each aperture 6 is circular as shown in FIG. 4, the shape of each aperture 6 is not so limited but may be elliptic, triangular, parallelogrammic, or any other appropriate shape for the print effect desired.

The control device for each electrode will now be described. As shown in FIG. 1, a control voltage applying circuit 8 is connected between the control electrodes 4 and the toner carrying roller 14. The control voltage applying circuit 8 is adapted to apply a voltage of −30 V or +30 V to the control electrodes 4 according to an image signal fed from a CPU 34 which will be hereinafter described. The toner carrying roller 14 is grounded.

Further, a back voltage applying circuit 24 is connected between the back electrode roller 22 and the toner carrying roller 14. The back voltage applying circuit 24 is adapted to apply a voltage of +1 kV (attracting voltage) or −1 kV (inhibiting voltage) to the back electrode roller 22 according to a drive signal from the CPU 34.

The CPU 34 is connected to an external computer, an image reading device, an image communication device, or other image data source, and is adapted to operate according to a flowchart to be hereinafter described.

A toner supplying operation will first be described with reference to FIG. 1. The toner 16 stored in the toner case 11 is supplied toward the toner carrying roller 14 by the rotation of the supply roller 12 in the direction of the arrow. The toner 16 thus supplied is rubbed against the toner carrying roller 14 and is accordingly charged negatively to be carried on the toner carrying roller 14. The toner 16 thus carried on the roller 14 is fed by the rotation of the toner carrying roller 14 in the direction of the arrow with the deposition of the toner 16 on the cylindrical surface of the roller 14 being maintained. Thereafter, the toner 16 carried on the cylindrical surface of the toner carrying roller 14 is formed into a thin layer by the toner layer restricting blade 18. Simultaneously, the charge of the toner 16 is made uniform by the toner layer restricting blade 18. The thin layer of the toner 16 is next fed toward the aperture electrode unit 1 by the further rotation of the toner carrying roller 14 in the direction of the arrow. Finally, the toner 16 on the toner carrying roller 14 is rubbed against the insulating sheet 2 of the aperture electrode unit I to reach a position just under the apertures 6.

Figure 2:
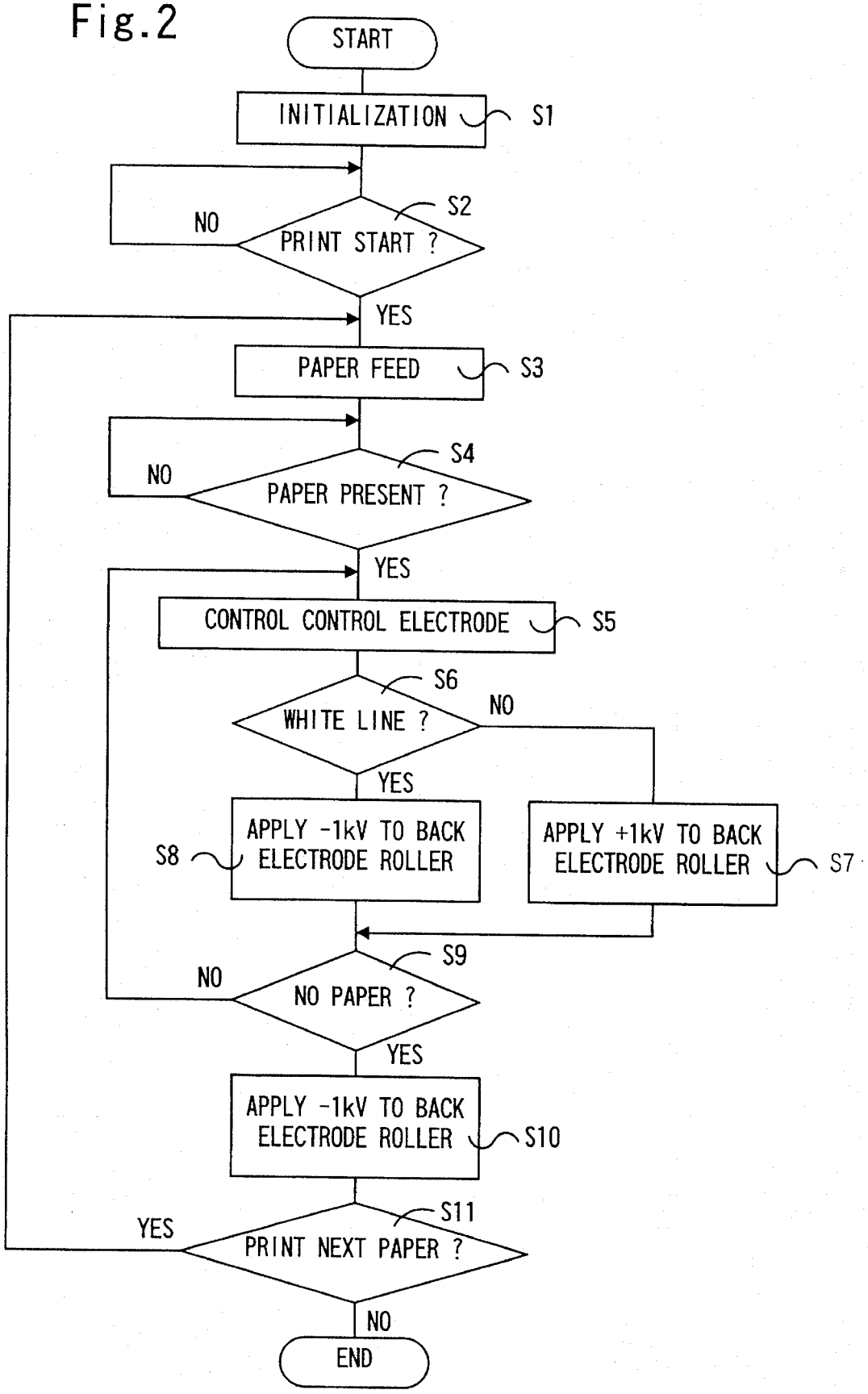
FIG. 2 is a flowchart for illustrating the operation of the image forming apparatus according to the preferred embodiment.
Figure 3:
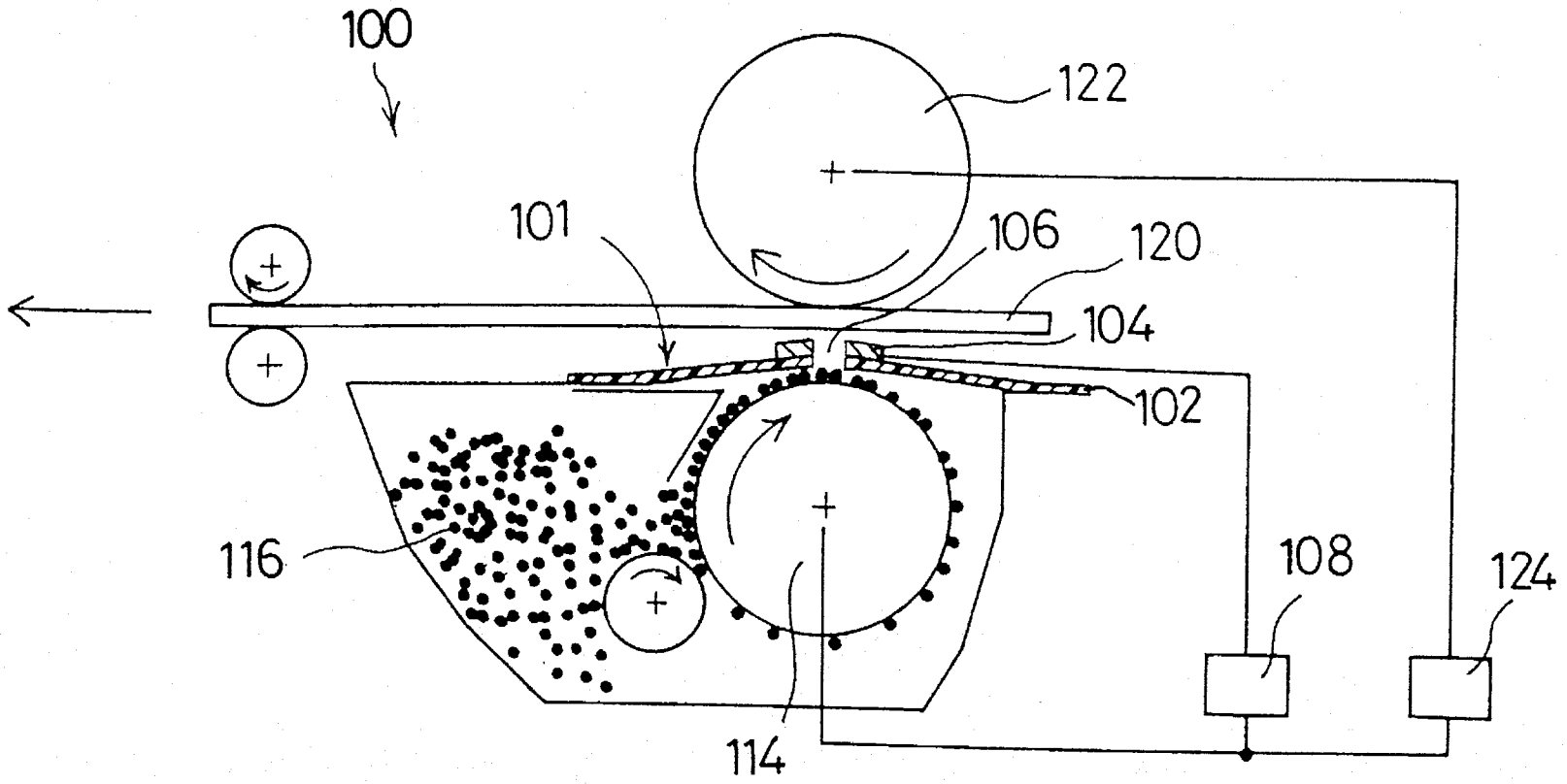
Fig.3 PRIOR ART
FIG. 3 is a cross-sectional view showing the structure of an image forming apparatus of the prior art.

When the image forming apparatus 50 is powered on (FIG. 2), the CPU 34 initializes the control voltage applying circuit 8 and the back voltage applying circuit 24 in step 1 (which will be hereinafter referred to as S1; the same reference step designation system will apply also to other steps). More specifically, the CPU 34 controls the control voltage applying circuit 8 so as to apply a voltage of −30 V to all the control electrodes 4, and also controls the back voltage applying circuit 24 so as to apply an inhibiting voltage of −1 kV to the back electrode roller 22. Accordingly, any residual toner deposited in the vicinity of the apertures 6 is inhibited from being attracted to the back electrode roller 22 by the inhibiting voltage. Thus, the back electrode roller 22 is prevented from being stained with the toner 16.

When a print command is supplied from an external device to the CPU 34, the CPU 34 determines that printing is to be started (S2: YES), and drives the feed rollers 30 to feed the paper 20 toward the aperture electrode unit 1 (S3). When the CPU 34 determines that the front or lead edge of the paper 20 has reached a position just over the apertures 6 after the paper 20 is fed by the feed rollers 30 and is detected by the sensor 32 (S4: YES), the CPU 34 supplies an image signal to the control voltage applying circuit 8 so as to control appropriate ones of the plurality of control electrodes 4 (S5).

The control voltage applying circuit 8 applies a voltage of +30 V to the control electrodes 4 corresponding to an image portion defined by the image signal. As a result, lines of electric force directing from the voltage applied control electrodes 4 toward the toner carrying roller 14 are so formed as to pass the apertures 6 surrounded by the voltage applied control electrodes 4, by a potential difference between the voltage applied control electrodes 4 and the toner carrying roller 14. As a result, the toner 16, which is negatively charged, undergoes an electrostatic force in a higher potential direction, and is therefore transferred from the toner carrying roller 14 through the apertures 6 toward the control electrodes 4.

Next, the CPU 34 determines whether a voltage of −30 V is to be applied to all of the control electrodes 4 according to the image signal (S6). In this case, where the voltage of −30 V is applied to all of the control electrodes 4, a white line is formed on the paper 20, that is, no toner image is formed on the paper 20. If the CPU 34 determines that the image signal does not correspond to the white line (S6: NO), the CPU 34 controls the back electrode applying circuit 24 so as to apply an attracting voltage of +1 kV to the back electrode roller 22 (S7).

The toner 16 transferred toward the control electrodes 4 is next attracted toward the paper 20 by the electric field formed between the paper 20 and the aperture electrode unit 1 by the attracting voltage of +1 kV applied from the back electrode applying circuit 24 to the back electrode roller 22. Thus, the toner 16 attracted to the paper 20 is deposited on the paper 10 to form a line of pixels on the paper 20.

At the same time, a voltage of −30 V is applied from the control voltage applying circuit 8 to the control electrodes 4 corresponding to non-image portions. As a result, no lines of electric force directing from the non-image control electrodes 4 toward the toner carrying roller 14 are formed between the toner carrying roller 14 and the non-image control electrodes 4, so that the toner 16 on the toner carrying roller 14 does not undergo an electrostatic force and therefore does not pass through the apertures 6 surrounded by the non-image control electrodes 4. Accordingly, no pixels are formed on a portion of the paper 20 opposed to the non-image control electrodes 4.

If the CPU 34 determined that the image signal corresponds to the white line (S6: YES), the CPU 34 controls the back electrode applying circuit 24 so as to apply an inhibiting voltage of −1 kV to the back electrode roller 22 (S8). Accordingly, any toner 16 erroneously passing through the apertures 6 can be prevented from being attracted toward the back electrode roller 22 by the inhibiting voltage of −1 kV applied to the back electrode roller 22, so that formation of a toner image by the toner 16 at a white line portion on the paper 20 can be prevented.

After thus forming a line of pixels by the toner 16 on the paper 20, the paper 20 is further fed in an amount corresponding to one pixel in a direction perpendicular to the array of the apertures 6 by the feed rollers 30. Then, the image forming process shown by steps S5 to S8 is repeated to thereby form a toner image on the whole surface of the paper 20. Thereafter, the toner image formed on the paper 20 is fed to the fixing device 26 and is fixed to the paper 20 by the fixing device 26. The fixing device 26 may be of any type such as a heat fixing type or a pressure fixing type.

When the paper 20 is further fed by the feed rollers 30, the absence of the paper 20 is detected by the sensor 32, and the CPU 34 determines that the rear or trail edge of the paper 20 has reached the position just over the apertures 6 (S9: YES), the CPU 34 controls the back voltage applying circuit 24 so as to apply an inhibiting voltage of −1 kV to the back electrode roller 22. Accordingly, when the paper 20 is absent between the toner carrying roller 14 and the back electrode roller 22, any toner 16 that might erroneously pass through the apertures 6 can be prevented from being attracted toward the back electrode roller 22 by the inhibiting voltage of −1 kV applied to the back electrode roller 22. As a result, it is possible to prevent staining of the back electrode roller 22 with the toner.

The CPU 34 next determines whether a subsequent sheet of paper 20 is present (S11). If a subsequent sheet of paper 20 is present, the operation of step S3 and the following steps is repeated to form an image on the subsequent sheet of paper 20, whereas if a subsequent sheet of paper 20 is absent, the operation is ended. Thus, the above-mentioned process is repeated to thereby record an image on a plurality of sheets of paper 20.

In the prior art apparatus 100 mentioned above, the uncontrolled toner 116 occasionally passes through the apertures 106 to be attracted toward the back electrode roller 122 when a large part of the paper 120 (especially, a lead edge portion or a trail edge portion of the paper 120) is at a non-printing portion, or in a space between the continuously fed sheets of paper 120. As a result, there sometimes occurs fog on the paper 120 or stain on the back electrode roller 122 itself with the toner 116 in the prior art apparatus 100.

To the contrary, according to the apparatus of this preferred embodiment, an inhibiting voltage, e.g., −1 kV in this preferred embodiment, prevents the attraction of the toner 16, is applied by the back voltage applying circuit 24 when the apparatus is in a non-printing state. Accordingly, even when the toner 16 erroneously passes through the apertures 6, the attraction of the toner 16 toward the back electrode roller 22 is prevented.

The non-printing state of the apparatus in this preferred embodiment corresponds to any time period during which the toner must not be attracted, which time period includes a time period during which printing is not performed on a sheet of paper according to image data, a time period during which a space between continuously fed sheets of paper passes above the apertures, a time period from power-on of the apparatus to the start of printing, and a time period from the end of printing to power-off of the apparatus.

It is to be noted that the invention is not limited to the above preferred embodiment, but various modifications may be made without departing from the scope of the invention.

For example, although the control voltage for the apertures 6 corresponding to a non-printing portion is set to −30 V in the above preferred embodiment, this voltage may be set to 0 V. In this case, lower-voltage drive can be realized.

Further, although the inhibiting voltage for the back electrode roller 22 is set to −1 kV in the above preferred embodiment, this voltage may be set to 0 V or a very low positive voltage. In any case, the inhibiting voltage must only be set to a voltage which can prevent the jumping of the toner 16.

Further, although the aperture electrode unit is used as the toner flow control means in the above preferred embodiment, a network electrode unit as described in U.S. Pat. No. 5,036,341 or an edge electrode unit having a recording edge portion as described in U.S. patent application Ser. No. 08/205,827 may be used instead of the aperture electrode unit, the disclosures of these documents being incorporated by reference thereto.

What is claimed is:

1. An image forming apparatus, comprising:

an electrode array having a plurality of charged particle passing portions and a plurality of control electrodes respectively corresponding to said charged particle passing portions;

charged particle supplying means for supplying charged particles to said charged particle passing portions of said electrode array;

a back electrode located opposite to said charged particle supplying means with respect to said electrode array, for attracting said charged particles passed through said charged particle passing portions toward an image recording medium; and back voltage control means connected to said back electrode, for selectively applying to said back electrode an attracting voltage for attracting said charged particles and an inhibiting voltage for inhibiting attraction of said charged particles.

2. An image forming apparatus according to claim 1, wherein said back voltage control means applies the inhibiting voltage to said back electrode when printing on said image recording medium is not carried out.

3. An image forming apparatus according to claim 1, wherein said back voltage control means applies the inhibiting voltage to said back electrode when the image recording medium is not located at a position corresponding to said charged particle passing portions.

4. An image forming apparatus according to claim 1, wherein the attracting voltage and the inhibiting voltage applied by said back voltage control means are reverse in polarity to each other.

5. An image forming apparatus for forming an image on a print medium, comprising:

a toner particle supply apparatus supplying toner particles having a polarity;

an aperture electrode having a plurality of electrodes for passing the toner particles, a control electrode associated with each aperture;

a back electrode on a side of the aperture electrode opposite the toner particle supply apparatus;

a control voltage applying circuit for supplying a control voltage to selected control electrodes;

a back electrode applying circuit for selectively supplying an attracting voltage and an inhibiting voltage to the back electrode; and a controller for controlling the voltages supplied by the control voltage applying circuit and the back electrode applying circuit.

6. The image forming apparatus according to claim 5, wherein the control voltage applying circuit outputs a voltage to control electrodes at image positions of a polarity opposite to the polarity of the toner particles to pass the toner particles through the associated apertures to the print medium based upon control signals from the controller.

7. The image forming apparatus according to claim 6, wherein the control voltage applying circuit outputs one of no voltage or a voltage of the same polarity as the polarity of the toner particles to control apertures at non-image positions thereby precluding passage of the toner particles through the associated apertures to the print medium based upon the control signals from the controller.

8. The image forming apparatus according to claim 6, further comprising determination means for determining for a print line whether any image positions exist.

9. The image forming apparatus according to claim 8, wherein when the determination means determines no image positions exist in the print lines, the back electrode voltage applying circuit outputs the inhibiting voltage.

10. The image forming apparatus according to claim 9, wherein the inhibiting voltage is one of 0 volts or a predetermined voltage have a polarity the same as the polarity of the toner particles.

11. The image forming apparatus according to claim 8, further comprising a sensor system for determining whether the print medium is present between the aperture electrode and the back electrode.

12. The image forming apparatus according to claim 11, when one of the determination means determines no image positions exist in the print lines and the sensor system determines there is no print medium between the aperture electrode and the back electrode, the back electrode voltage applying circuit outputs the inhibiting voltage.

13. The image forming apparatus according to claim 12, wherein the inhibiting voltage is one of 0 volts or a predetermined voltage have a polarity the same as the polarity of the toner particles.

14. The image forming apparatus according to claim 6, further comprising a sensor system for determining whether the print medium is present between the aperture electrode and the back electrode.

15. The image forming apparatus according to claim 14, wherein when the sensor system determines no print medium is present, the back electrode voltage applying circuit outputs the inhibiting voltage.

16. The image forming apparatus according to claim 15, wherein the inhibiting voltage is one of 0 volts or a predetermined voltage have a polarity the same as the polarity of the toner particles.

* * * * *